US005882265A

United States Patent [19]

Benton

[11] Patent Number: 5,882,265

[45] Date of Patent: Mar. 16, 1999

[54] VERTICALLY STORABLE AND SELF-LEVELING BILLIARD TABLE

[76] Inventor: John H. Benton, 32340 Pacific Coast Hwy., Malibu, Calif. 90265

[21] Appl. No.: 720,156

[22] Filed: Sep. 25, 1996

[51] Int. Cl.[6] ..... A63B 71/00

[52] U.S. Cl. ..... 473/15

[58] Field of Search ..... 473/12, 15; 414/401; 108/147, 133

[56] References Cited

U.S. PATENT DOCUMENTS

| | | | |
|---|---|---|---|
| 329,734 | 11/1885 | Gosner . | |
| 503,261 | 8/1893 | Bereuter | 473/12 |
| 1,237,417 | 8/1917 | Treiber . | |
| 1,243,161 | 10/1917 | Grode . | |
| 1,317,768 | 10/1919 | Treiber et al. . | |
| 2,237,418 | 4/1941 | Fender et al. . | |
| 3,080,835 | 3/1963 | Guglielmi . | |
| 3,585,945 | 6/1971 | Nielsen . | |
| 3,743,287 | 7/1973 | Liermann . | |
| 3,744,812 | 7/1973 | Langhausen . | |
| 3,889,945 | 6/1975 | Ellis | 473/12 |
| 3,910,576 | 10/1975 | Leonhart . | |
| 3,988,021 | 10/1976 | Grover . | |
| 4,305,581 | 12/1981 | Neuharth . | |
| 4,336,936 | 6/1982 | Young . | |
| 4,381,714 | 5/1983 | Henneberg | 108/147 |
| 4,534,565 | 8/1985 | Hube . | |
| 4,964,643 | 10/1990 | Hass . | |
| 5,020,799 | 6/1991 | Chang . | |
| 5,033,751 | 7/1991 | Ching . | |
| 5,056,780 | 10/1991 | Tsang . | |
| 5,100,151 | 3/1992 | Lyon et al. . | |
| 5,297,921 | 3/1994 | Springer | 414/401 |
| 5,320,047 | 6/1994 | Deurloo et al. . | |
| 5,330,197 | 7/1994 | Bair . | |
| 5,413,051 | 5/1995 | Tseng . | |
| 5,490,467 | 2/1996 | Diffrient | 108/133 |

FOREIGN PATENT DOCUMENTS

| | | | |
|---|---|---|---|
| 877 | 2/1883 | United Kingdom | 473/12 |

*Primary Examiner*—Theatrice Brown

*Attorney, Agent, or Firm*—Irah H. Donner; Pepper Hamilton LLP

[57] ABSTRACT

A self-storing billiard table includes a table top with ball pockets and side cushions. A support frame is disposed below the table top to support it. A plurality of retractable support legs are also provided to support the billiard table. A first set of support legs is located near a first side of the billiard table, and a second set of support legs is located near a second side of the billiard table. The first set of support legs is retractably connected to the support frame. A plurality of wheels are also retractably connected to the support legs. At least one retractable ram pivotally supports the billiard table when moved from an upright storage position to a horizontal playing position, and from a horizontal playing position to an upright storage position.

17 Claims, 11 Drawing Sheets

VERTICALLY STORABLE AND SELF-LEVELING BILLIARD TABLE

TECHNICAL FIELD

The present invention generally relates to billiard tables, and more particularly, to a billiard table that is vertically storable and/or self-leveling. When the billiard table is not in use, the table can be repositioned such that the normally horizontal table and playing surface is placed vertically on end for storage.

BACKGROUND ART

A conventional billiard table generally requires that a large area be set aside in order to set up the table and allow the user plenty of room to play the game. For example, a conventional billiard table has a table face approximately 4.5'×8'. The billiard table of the conventional size is normally quite heavy, having been manufactured with a slate or other suitable stone top covered in felt, and supported by a wood base. A user cannot be expected to move the billiard table by his/herself. When installed, the billiard table is normally placed in position within a room where it is expected to remain.

During installation of the billiard table, the table top surface is leveled, generally by shimming the legs or supports of the table, and by leveling the slate itself. Once a room has been set aside for the billiard table, the area occupied by the table and the necessary perimeter set aside for the players are considered unusable or unsuitable for other purposes or activities. That is, billiard tables generally require an area that is dedicated for play.

Attempts have been made to re-use the billiard table playing area to alleviate the need for dedicating a specific area for the billiard table. For example, folding billiard tables of various designs are known in the art. U.S. Pat. No. 5,056,780 to Tsang describes a folding billiard table having a frame member with legs that support a billiard table face. A pair of legs disposed on one side of the main support legs are foldable, and another pair on the other side of the main support legs are liftable and foldable.

In Tsang, when the table is not in use, the billiard table face can be turned upward, with the liftable and foldable lateral support legs raised, so that the billiard table face can be turned from a horizontal position to a vertical position to reduce the room occupied by the table. This is accomplished by the user upwardly turning the billiard table face in a predetermined direction whereby the table rotates about fulcrums, and the joints of the foldable lateral support legs are folded. After folding, the gravitation center of the billiard table is stable. The folding and unfolding of the billiard table, as well as leveling of the billiard table top, are accomplished manually using a complex scheme of long and short linkages.

U.S. Pat. No. 5,020,799 to Chang describes a folding billiard table formed in two pieces. When the table is folded for storage, the table top is bisected and folded in half. While this may minimize storage space for the table top, the ideal playing surface for a billiard table incorporates one smooth table top of a unitary construction.

Accordingly, I have realized that a need exists for a billiard table with a full size table top, mounted on a conventional billiard table frame that may be vertically pivoted for storage. I have also realized that there exists the need for a self-leveling mechanism such that when the billiard table is placed back in the horizontal playing position, the billiard table top can be leveled, with accuracy and ease.

DISCLOSURE OF THE INVENTION

The present invention was conceived as a self-leveling billiard table storable in the vertical position for use by billiard enthusiasts lacking the necessary floor space required to set up a billiard table for extended durations. The billiard table according to the present invention is attained utilizing a conventional billiard table top, preferably made of slate, resting on sturdy material such as a steel slab or frame, and hydraulic pistons strategically placed below the steel slab for leveling the billiard table top. The billiard table top is positioned over a billiard table frame for support. The billiard table frame conceals any hydraulics, including hydraulic pump and lines, that may be used for leveling the billiard table top.

The billiard table support frame rests on top of foldable and retractable legs. The legs are used to pivot the billiard table for storage. The legs are operated upon by the hydraulics within the billiard table support frame. Retractable rams are also located within the billiard table's support frame for use as pivots and additional support when the table is translated from the horizontal playing position into a vertical storage position. Included optionally within the legs of the billiard table are extendable or retractable wheels that may be used for positioning the billiard table to a preferred location within a room.

A further feature and advantage of the invention includes the addition of brakes attached to the billiard table support legs, preventing the billiard table from moving laterally following placement within a room.

In accordance with the present invention, a self-storing billiard table includes a table top with ball pockets and side cushions. A support frame is disposed below the table top to support it. A plurality of retractable support legs are also provided to support the billiard table. A first set of support legs is located near a first side of the billiard table, and a second set is located near a second side of the billiard table. The first set of support legs are retractably connected to the support frame. A plurality of wheels are also retractably connected to the support legs. At least one retractable ram is also included to pivotally support the billiard table when it is moved from an upright storage position to a horizontal playing position, and from a horizontal playing position to an upright storage position.

In accordance with another embodiment, a self-leveling billiard table includes a billiard table top with ball pockets and side cushions and a leveling support system. The leveling support system is disposed below the billiard table top and adapted to support the table top and level it. The leveling support system includes a support slab disposed on a plurality of leveling hydraulic pistons. The hydraulic pistons are connected to hydraulic lines which are filled with hydraulic fluid. The hydraulic fluid is driven by a hydraulic pump to level the table top. A multi-directional level disposed on the support slab controls the leveling action of the leveling support system.

Methods for leveling and storing the pool table are also provided.

Still other features and advantages of the present invention will become readily apparent to those skilled in the art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and descriptions are to be regarded as illustrative in nature, and not as restrictive.

BEST MODE FOR CARRYING OUT THE INVENTION

Figure 1A:
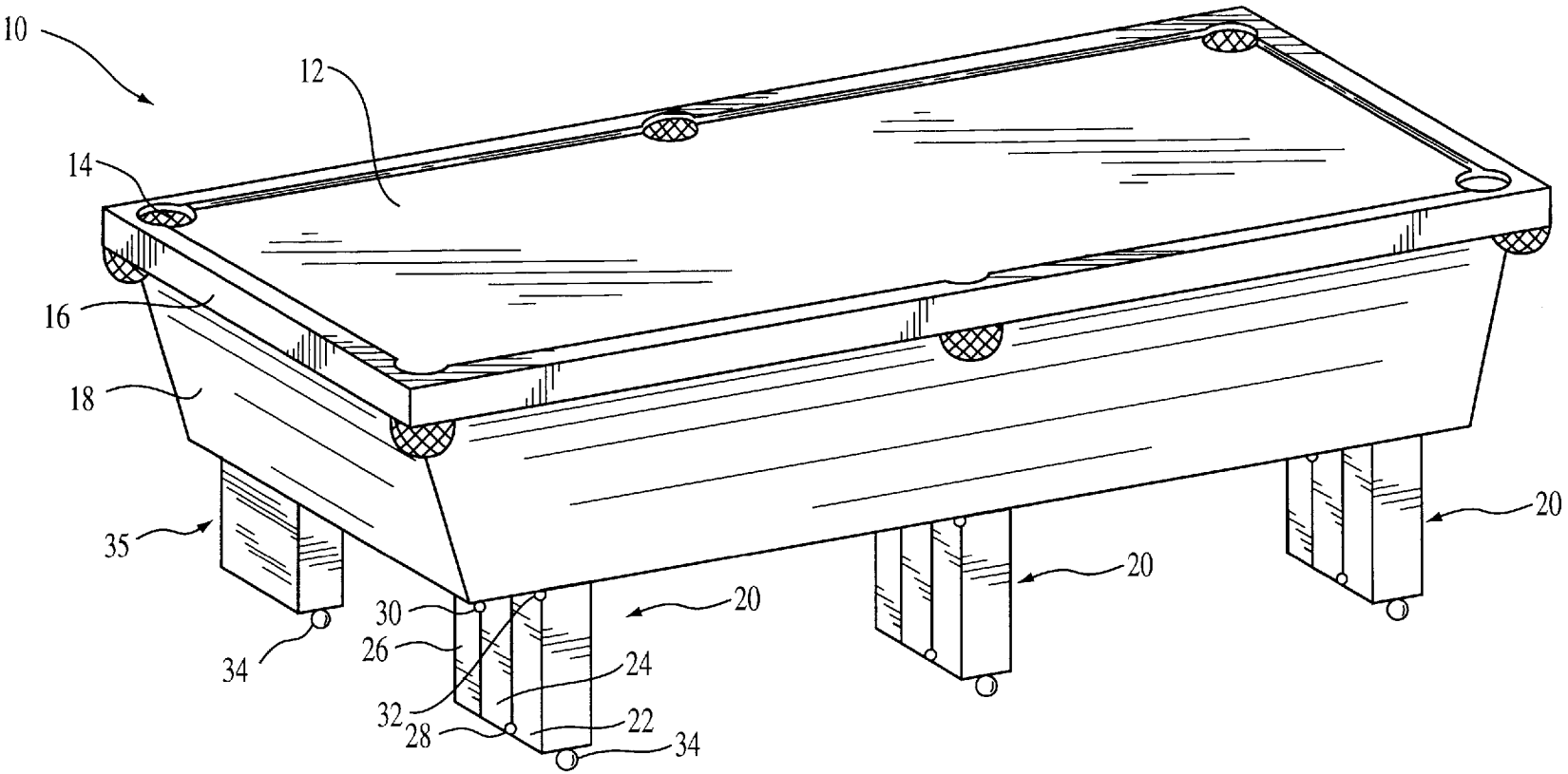
FIG. 1A is a first perspective view of the folding billiard table, according to a preferred embodiment of the present invention.
Figure 1B:
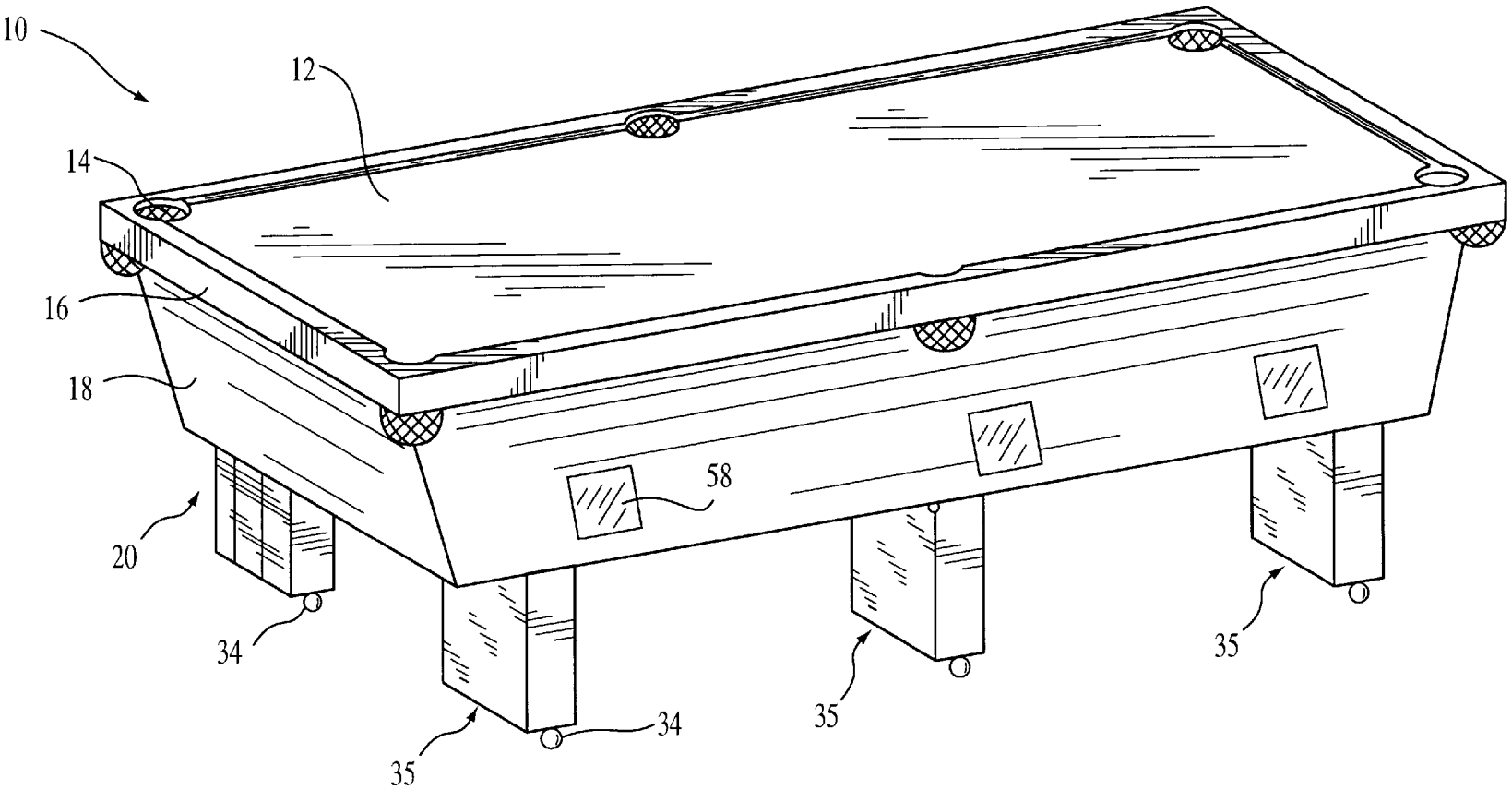
FIG. 1B is a second perspective view of the folding billiard table, according to a preferred embodiment of the present invention.
Figure 2:
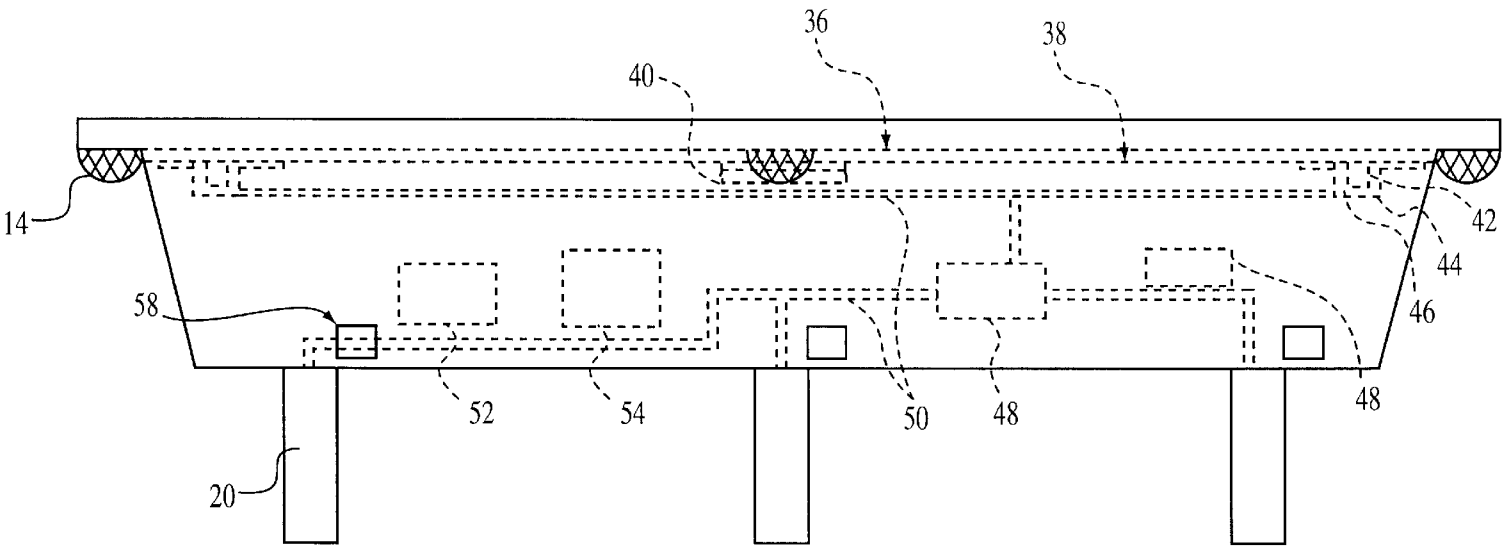
FIG. 2 is a side elevational view of the folding billiard table of FIG. 1.

Referring to FIGS. 1A, 1B and 2, a billiard table of the invention, generally designated with reference numeral 10, is comprised of a billiard table top 12, adapted to be disposed on a billiard table support frame 18. The billiard table support frame 18, when the billiard table 10 is in the horizontal playing mode, is disposed on foldable, retractable, expandable or extendable legs 20, 35. The retractable support legs 20, 35 have within them retractable wheels 34 which allow the billiard table 10 to be repositioned within a room.

The billiard table top 12 is conventional in size and comprises pockets 14 and bumpers 16 surrounding a slate playing surface 36. The billiard table top 12 is disposed on a steel slab 38 or other sturdy material or frame. The weight of the pool table is preferably at least 500 pounds, but may be as much as 1,000 pounds to provide a secure playing surface that is of high quality.

Figure 3:
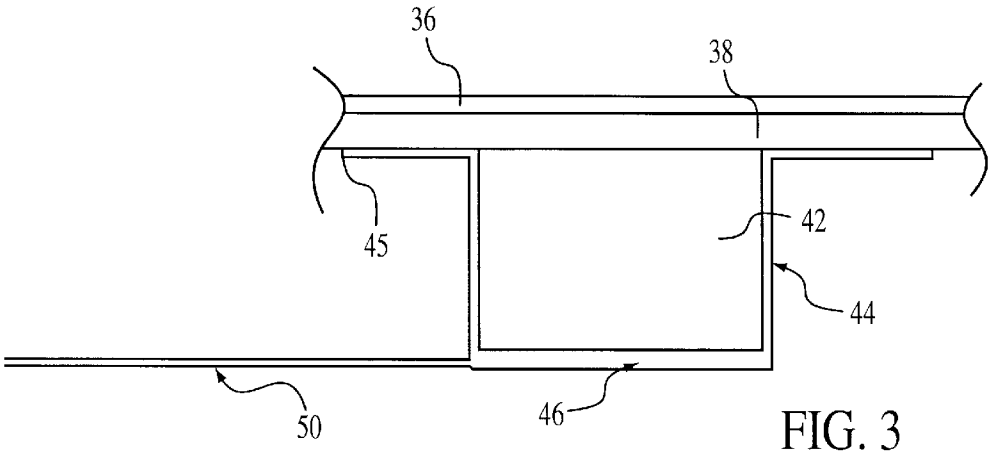
FIG. 3 is a side elevational view of one of the leveling pistons.

Steel slab 38 is disposed upon or connected to a series of pistons 42. The pistons 42 adjust the level of the steel slab 38 and thereby the billiard table top, in response to output of the level device/sensor 40. The piston 42 is inserted or disposed within a hydraulic reservoir 44 (FIG. 3) further containing hydraulic fluid 46. The hydraulic reservoir is connected to a hydraulic line 50 for receiving and expelling the hydraulic fluid. The hydraulic line 50 is connected to a hydraulic pump 48. When the billiard table 10 is in the horizontal playing position, the level device 40 measures the level of the playing surface at slate 36, and adjusts the amount of hydraulic fluid that is introduced to each of the hydraulic reservoirs so that the pistons 42 responsively adjust the playing surface 36 and playing top 12.

Retractable legs 20, 35, when in their extended position, support the billiard table 10 at the proper playing height. The retractable legs 20 are comprised of three hinged members 22, 24, 26. The retractable legs 20 can be expanded about the hinges to lift the billiard table as may be required, discussed in detail below. Retractable legs 35 are generally not required to be expandable. In this situation, the pool table 10 can be stored only vertically in the direction of retractable or expandable legs 35. However, if it is desired that the pool table 10 be storable in either direction, then retractable legs 35 are also expandable.

Optional retractable rams 58 are located on one side of the billiard table support frame 18 when retractable legs 35 are not expandable. When extended, retractable rams 58 act as pivot points and support for the billiard table 10. Note that retractable rams may also be provided on both sides of the pool table 10 when it is desired that the pool table 10 be storable in either direction. In this situation, retractable legs 35 will also be expandable, as discussed above.

Figure 4A:
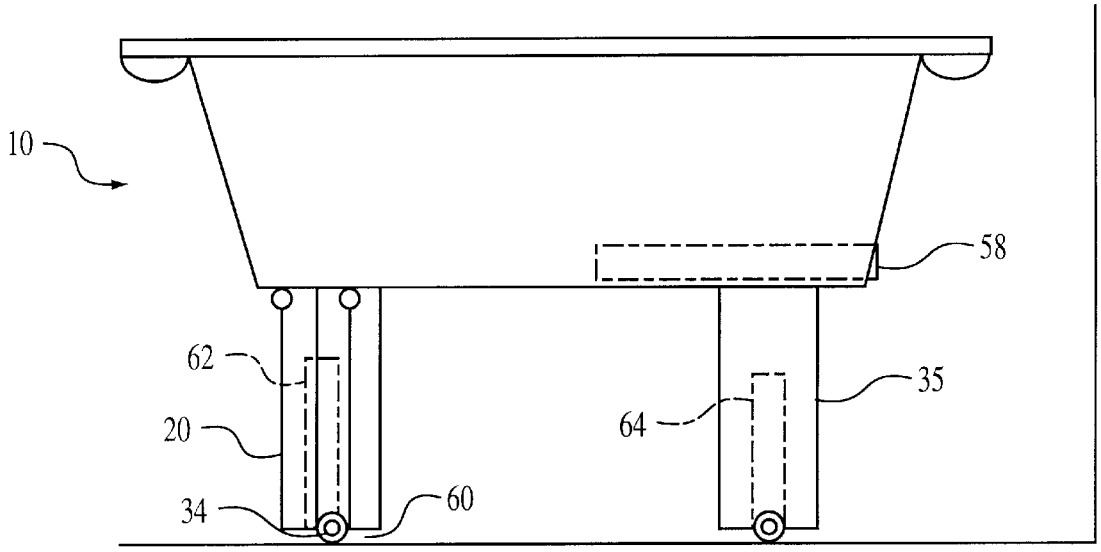
FIG. 4A depicts a side elevational view of a billiard table with the legs extended and the wheels extended, and the ram in the recessed position.

Sequence FIGS. 4A–4D depict billiard table 10 in playing position transitioned to its vertical stored position in accordance with the invention. In FIG. 4A, the ram 58 is in its retracted position, the retractable support legs 20, 35 are in their extended position. Retractable wheels 34 are, for example, in their extended position via wheel supports 62, 64 for retractable legs 20, 35, respectively. Space 60 is maintained between the ground surface and retractable legs 20, 35 to permit wheels 34 to be utilized.

Figure 4B:
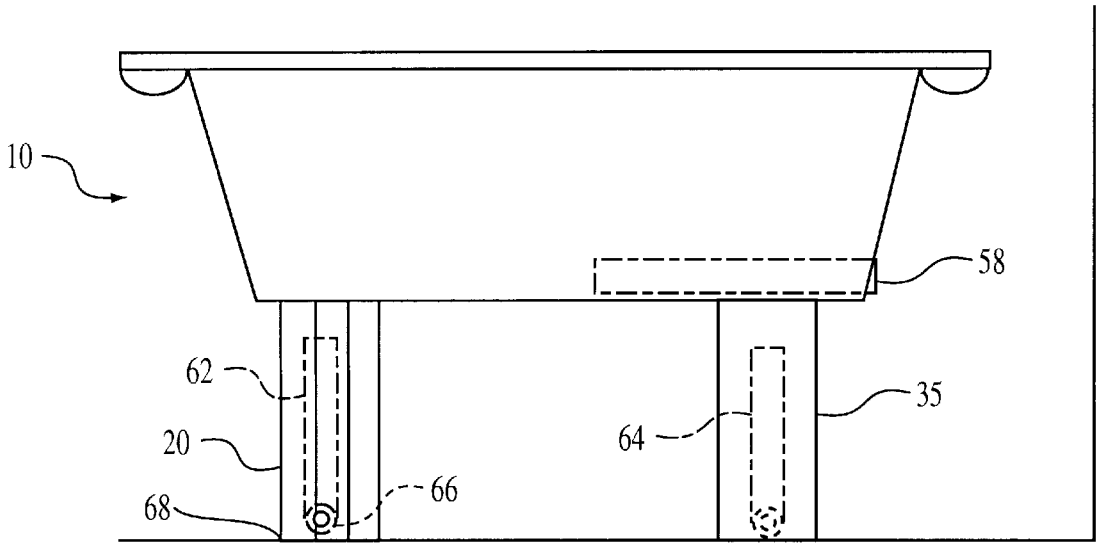
FIG. 4B depicts a side elevational view of the billiard table wherein the legs are in the extended position, the wheels are in the retracted position, and the ram is in the retracted position.

In FIG. 4B, ram 58 remains in its retracted position, and the billiard table support legs 20, 35 remain in their extended position. Wheels 34 have been retracted via supports 62, 64 and are depicted in their retracted position 66. Therefore, retractable legs 20, 35 rest on surface 68.

Figure 4C:
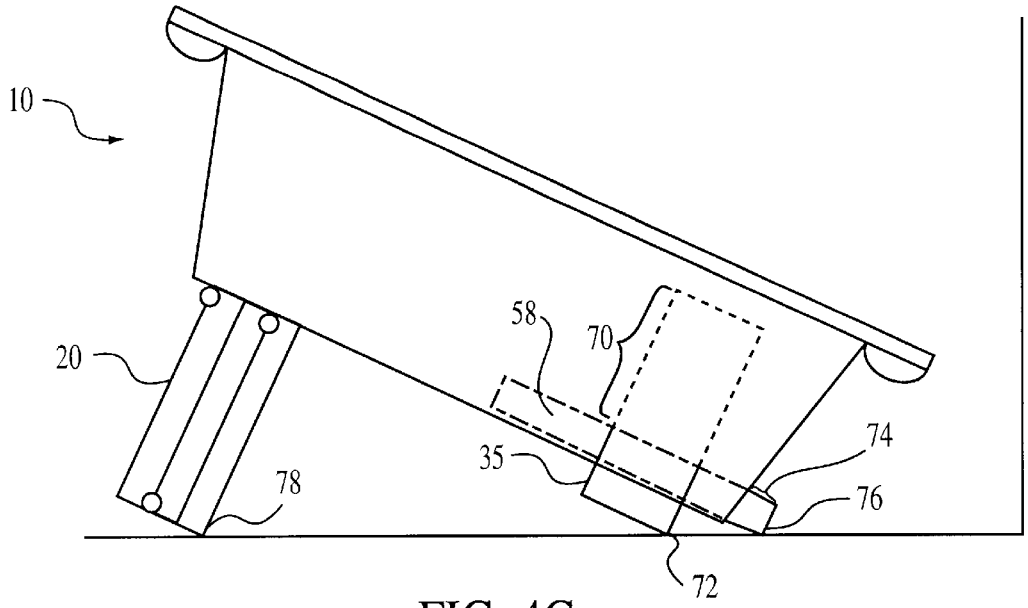
FIG. 4C is the side elevational view of the billiard table wherein a first set of legs are in the retracted position, and the ram remains in the retracted position and a set of folding legs remain in the extended position.

FIG. 4C depicts the billiard table support legs 35 that are not expandable in their partially retracted position 70 and engaging the ground surface at area 72. Ram 58 is in a partially extended position 74 and in engagement with the ground surface at area 76. Billiard table retractable support legs 20 remain in their extended position and engage the ground surface at area 78.

Figure 4D:
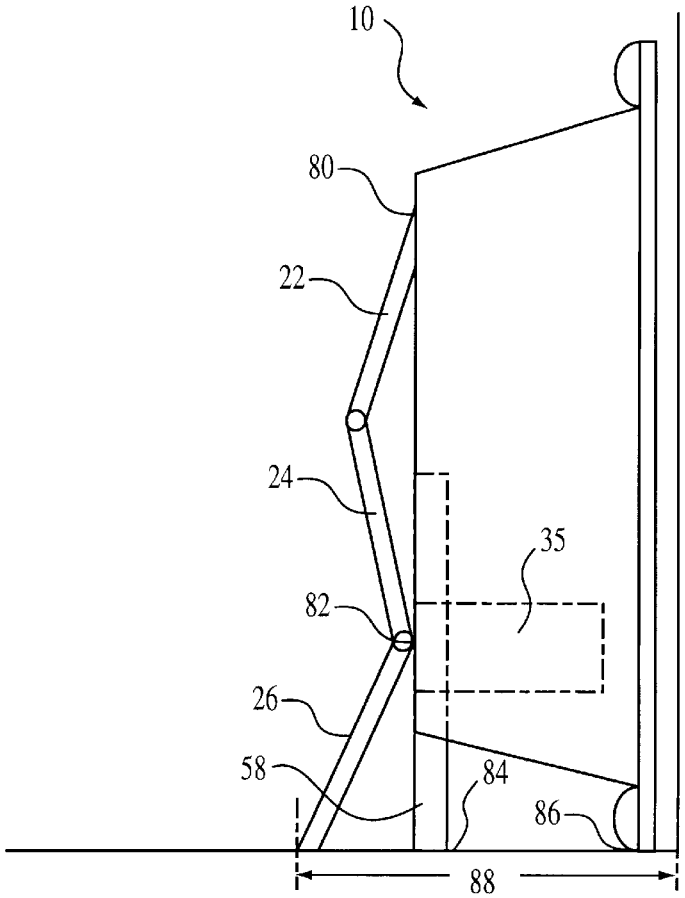
FIG. 4D shows the side elevational view of the billiard table in the vertical position, the ram is in the extended position, and the side folding legs are in an unfolded position.

FIG. 4D depicts the billiard table support legs 35 in their fully retracted position 70 and not engaging the ground surface at all. Billiard table retractable support legs 20 are in their fully expandable position and engage or support the pool table 10 at areas 80 and 82. To compensate for the loss of support from retractable leg 35, ram 58 is in a fully extended position and in engagement with the ground surface at area 84, and the pool table engages the ground surface at its lip area 86. Once in its fully vertical stored position, pool table 10 occupies space 88 for storage. As is readily observable from FIG. 4D, storage space 88 is only slightly larger than the width of pool table support frame 18, i.e., approximately 2'½".

Figure 5A:
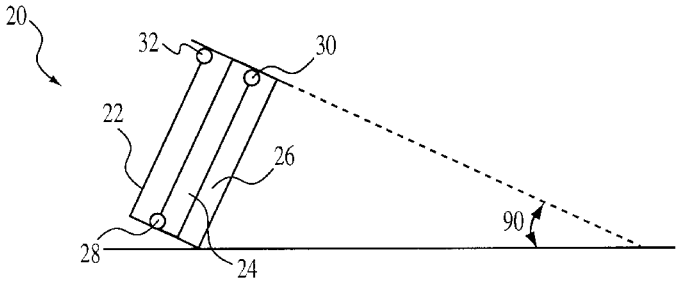
FIGS. 5A–5D are side elevational views of a lower leg unfolding in a sequence normally used to alter the position of a billiard table from a horizontal playing position to a vertical storage position.
Figure 5B:
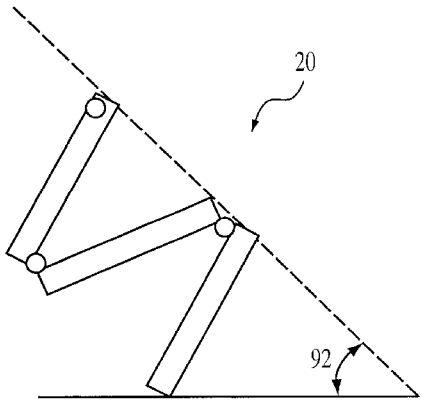
Figure 5C:
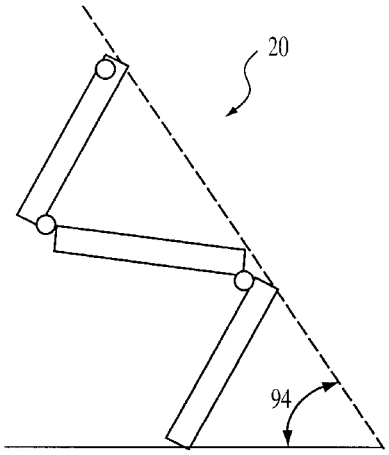
Figure 5D:
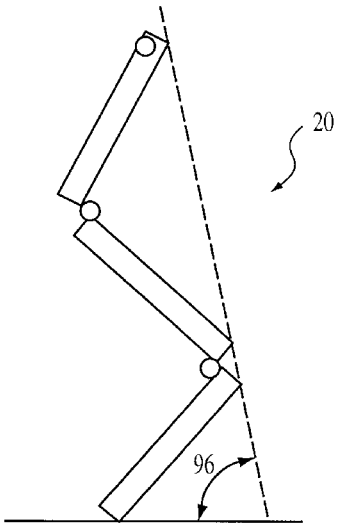

FIGS. 5A—5D depict the sequence of expansion experienced by the billiard table support legs 20 when the billiard table 10 is positioned from the horizontal playing position to the vertical storage position. FIG. 5A is the initial starting position of retractable legs 20 when legs 35 have been fully extended with the pool table 10 at an initial angle 90. FIGS. 5B–5D are intermediate positions for pool table 10 where the legs 20 are expanding resulting in the pool table being positioned at angle 92 (slightly greater than angle 90), angle 94 (slightly greater than angle 92), and angle 96 (slightly greater than angle 94).

The retractable legs 20 are comprised of three hinged members 22, 24, 26. The retractable legs 20 can be expanded about the hinges 28, 30 to lift the billiard table as may be required. An example of a retractable leg 20 that is suitable for this application are the expandable/contractable members used on a back hoe or scissor lift that provide a similar function.

Retractable leg 20 is attached to the pool table 10 underneath at connection area 32. By unfolding the billiard table support legs 20 (FIGS. 5A–5D) and simultaneously extending ram 58, the billiard table is pivoted about the extending ram 58 and, optionally, support leg 35 until the billiard table 10 is in the vertical orientation depicted in FIG. 4D.

Movement of the billiard table support legs 20, 35, the retractable wheels 34, ram 58, and the unfolding of the billiard table support legs 20 is accomplished utilizing the hydraulic pump 48. Alternatively, extension and retraction of ram 58, billiard table support legs 20, 35, retractable wheels 34, and the extension and retraction of the billiard table support legs 20, 35 can be accomplished using conventional manual cranks and gears, such as an egg beater device. Another suitable known device is a manually powered hydraulic device such as the back stay adjuster for a sail boat that is used to manually pull the mast back to adjust the sails. The adjuster manually pumps hydraulic fluid into the gear system to activate a mechanical device for pulling the mast aft or toward the stern of the boat to adjust the sails.

The retractable billiard table support legs 20 are attached to the billiard table support frame 18 at a hinged location 32. An hydraulic line, described below, enters the support leg 20 acting on the three leg components 22, 24, 26, in order to separate the leg components or converge the leg components as required to stand the billiard table 10 vertically or place the billiard table in a horizontal playing position, respectively.

Figure 6:
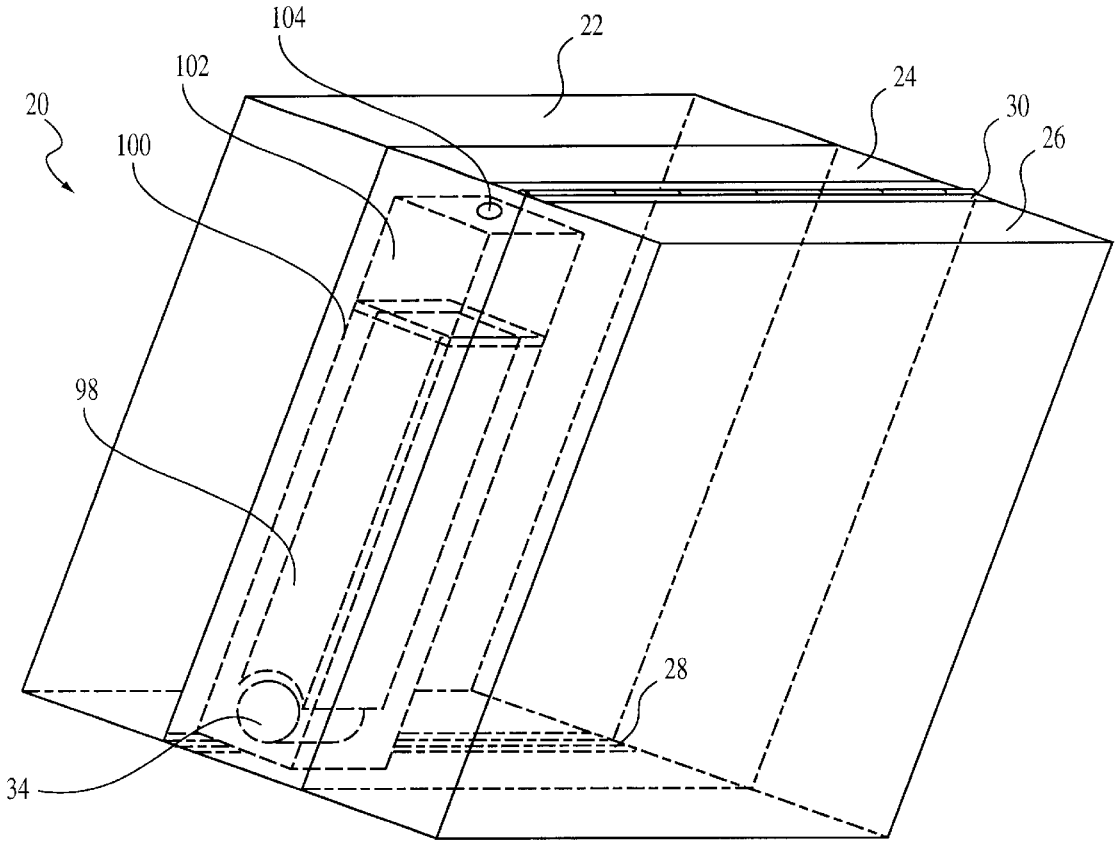
FIG. 6 is a perspective view of a foldable leg according to the preferred embodiment of the present invention.
Figure 6A:
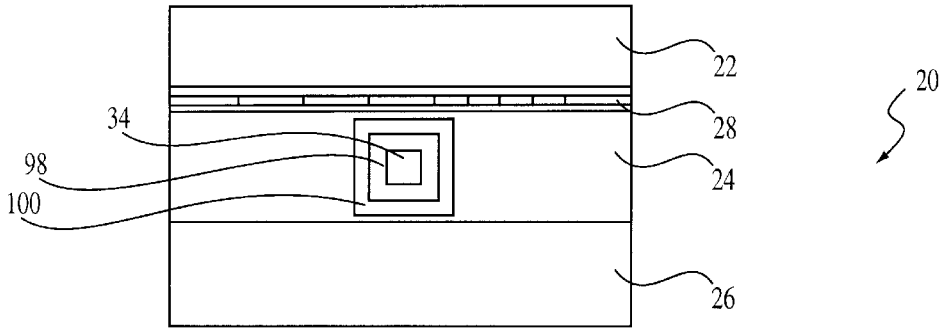
FIG. 6A is a bottom plan view of a folding support leg.

In FIGS. 6 and 6A, retractable wheel 34 is located within the middle leg component 24 in tube 100 via support 98. A local hydraulic gear system 102 is used to retract and extend support 98 and wheel 34. Hydraulic gear system 102 receives the hydraulic fluid via hydraulic line 104.

Figure 7:
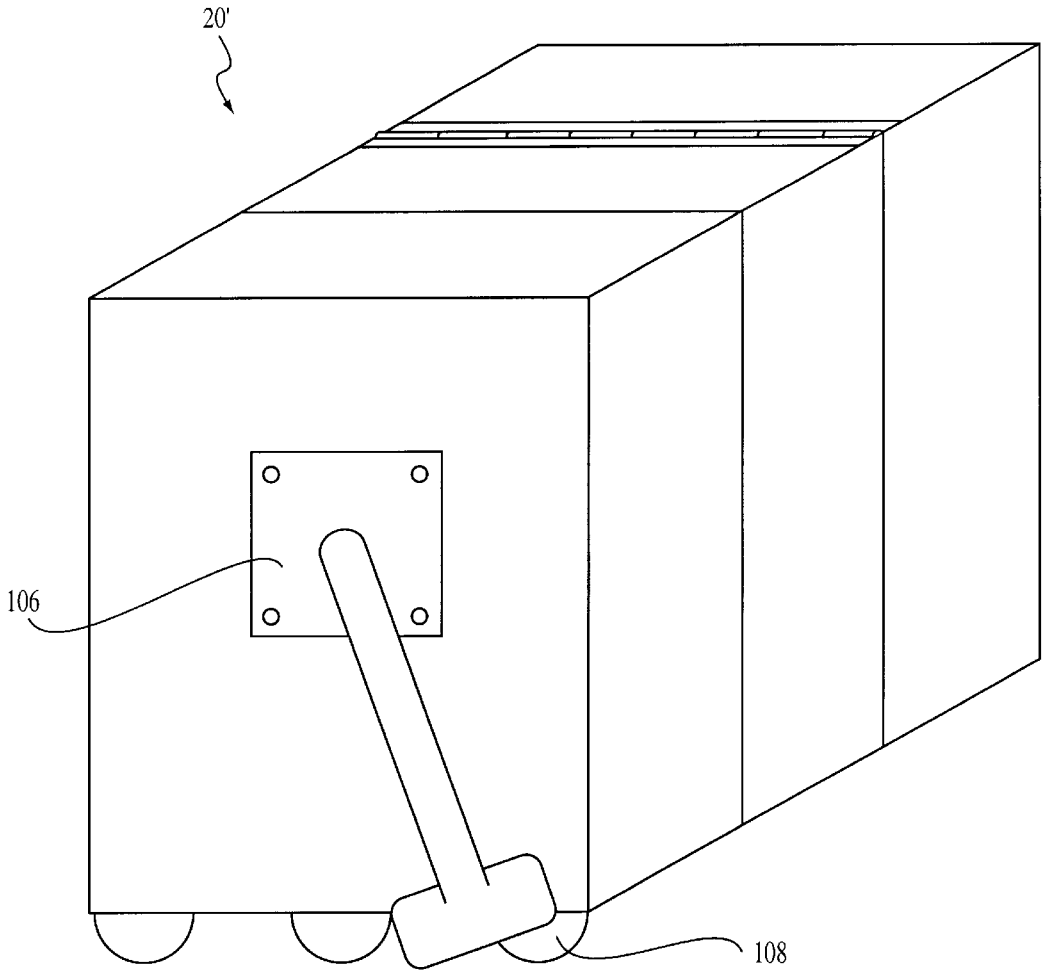
FIG. 7 is a perspective view of a foldable support leg depicting the braking mechanism.
Figure 7A:
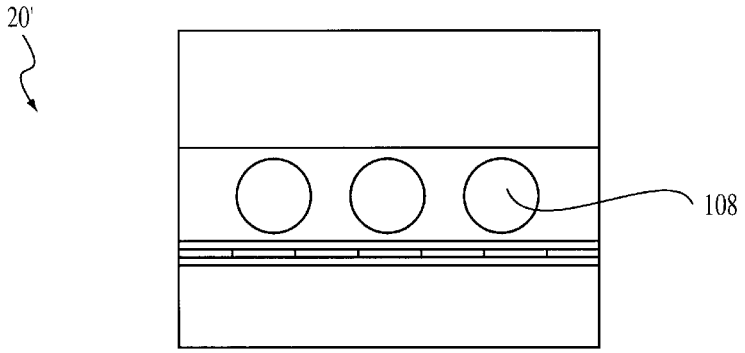
FIG. 7A is a bottom plan view of a folding support leg depicting the placement of ball bearings used for movement of the billiard table.

In FIG. 7, in accordance with another design, the outside surface of the billiard table support legs 20' have a braking mechanism 106 (similar to a bicycle kick stand) that can be manually positioned in order to prevent the billiard table from moving when it is in the horizontal playing position. As an alternative to retractable wheel 34, ball bearings 108 are placed in the middle leg component.

Figure 8:
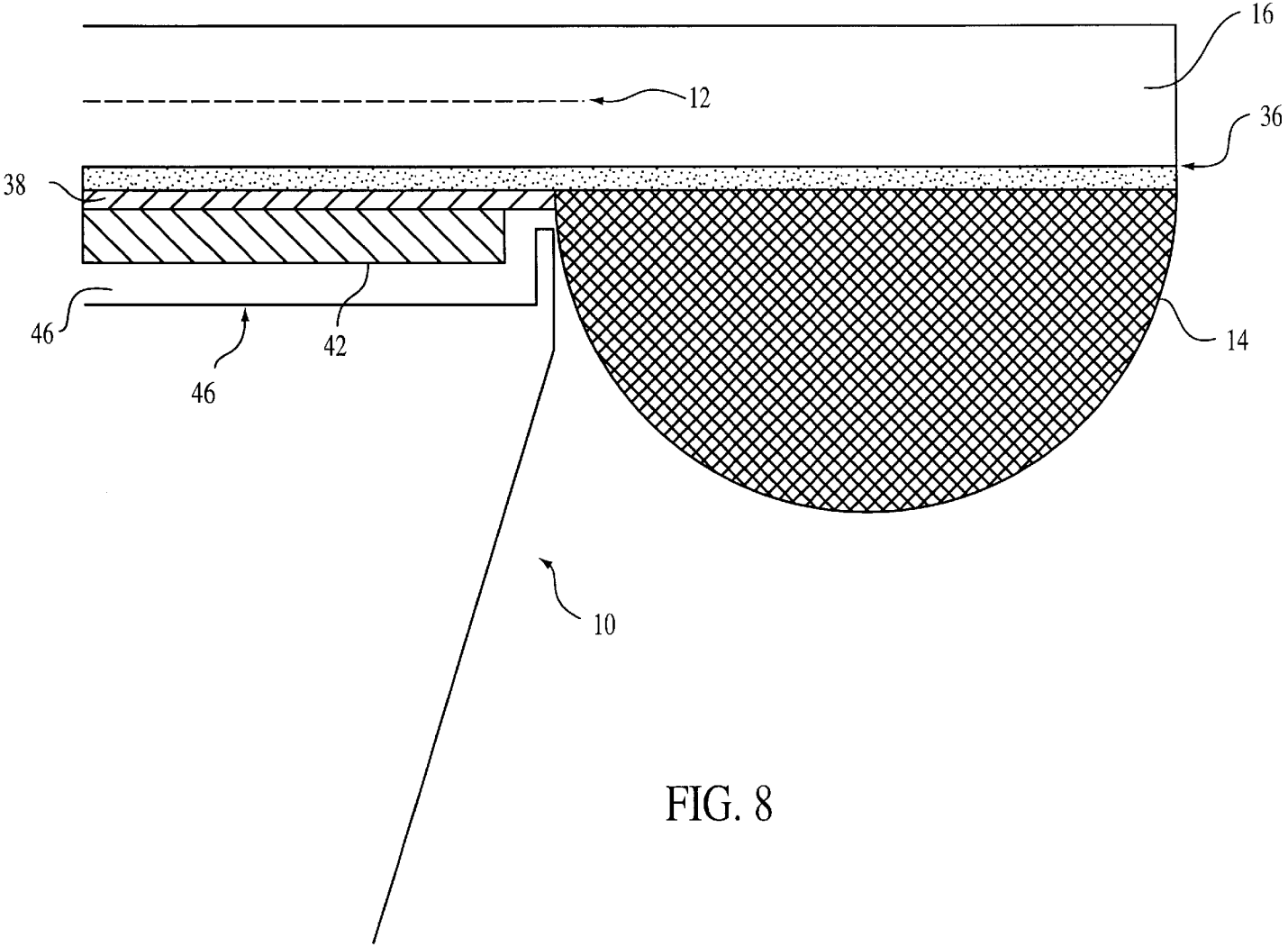
FIG. 8 is a side plan view of the billiard table top and the leveling mechanism.

FIG. 8 depicts an enlarged view of bumper 16 resting upon billiard table top slate 36, which in turn, rests on a steel slab 38. Steel slab 38 is maneuverable or movable via piston 42 located in hydraulic fluid reservoir 44 having hydraulic fluid 46 therein. Pocket 14 hangs beneath the slate 36 as normally required in a conventional billiard table. Thus, the entire playing surface including bumpers 16 are leveled automatically via the leveling of steel slab 38.

Figure 9:
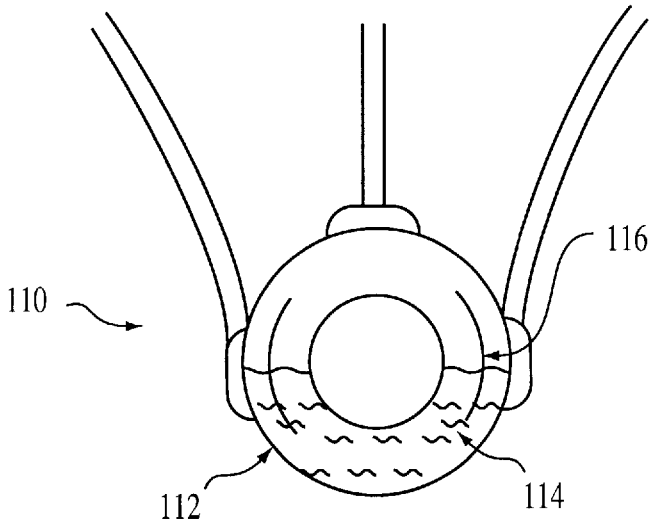
FIG. 9 depicts a level sensor.
Figure 10:
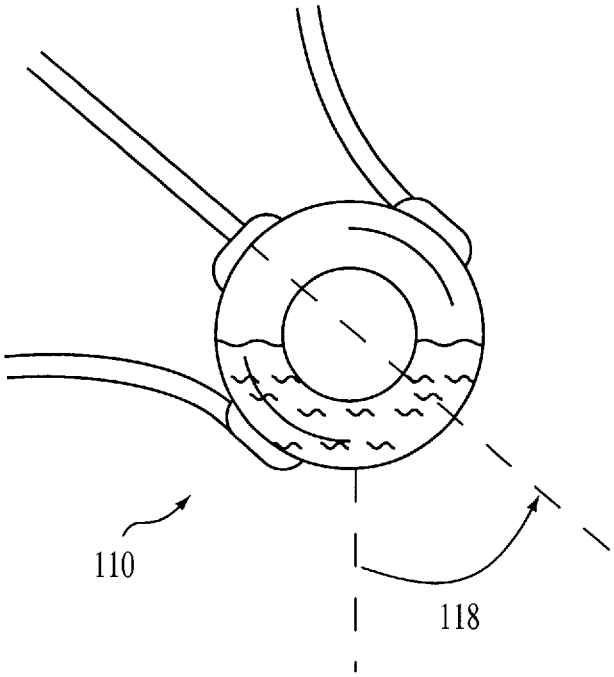
FIG. 10 depicts a level sensor in a rotated position.

A level sensor 110 depicted in FIG. 9 is an example of an electronic level sensor which may be utilized as the level for determining the level of the billiard table top relative to the ground. Level sensors operate on the same principle as a carpenter's level. A hollow glass disk 112 contains three metal plates 116 submerged in fluid 114. As this disk 112 tilts in a vertical plane, the fluid 114 remains level with respect to the ground and different areas of these metal plates 116 become exposed and submerged to the fluid in this glass disk (see FIG. 10).

The fluid 114 acts as a dielectric, changing the capacitance which then changes the phase and amplitude of the input AC wave form. The angle information 118 from the level sensor 110 is contained in the new phase and amplitude of the output wave form in a similar manner that a radio frequency carrier contains sound information.

In order to obtain the angle or level information 118, a standard Monolithic LVDT Driver Demodulator (e.g., Signetics NE5520) is preferably used to provide the sinusoidal drive to the sensor. The output waveform is then buffered to avoid loading, sent through a polar full wave rectifier to obtain phase and amplitude information and then filtered, leaving only the angle or level information in the form of a DC signal which is sent to an associated controller or computer for further level adjustment. Use of this type of level sensor 110 therefore requires electrical input and output to the level 40.

The level 40 and the hydraulic system/pump 48 depicted in FIG. 2 may both be powered by a battery 52 and battery charger 54, or alternatively, by AC plug-in power.

According to the above arrangement, the vertical storage operation of the pool table is as follows:

When the user is ready to store the billiard table 10 in a vertical position, the billiard table 10 is first rolled to a location near the storage wall. The billiard table 10 is then positioned along side the wall, such that the side of the billiard table 10 containing rams 58 are facing the wall. Once in position, the retractable wheels 34 are retracted within the billiard table support legs 20, 35 resulting in the billiard table support legs resting directly on the floor surface (See FIGS. 4A and 4B).

The support legs 35 located on the side of the billiard table 10 closest to the wall, are then retracted inside the pool table support frame 18 (FIG. 4C). Rams 58 are gradually extended from the billiard table support frame 18 acting as a pivot point for the billiard table 10. The billiard table support legs 20 farthest from the wall that remained in the extended position may now be opened or extended hydraulically, forcing the billiard table 10 to pivot on the ram 58 and optionally leg 35 and come to rest on its side in a vertical position.

As described previously in this connection, FIGS. 5A–5D depict the expansion or accordion-like sequence which the billiard table support legs 20, 35 undergo when the billiard table 10 is positioned from the horizontal playing position to the vertical storage position.

According to the above arrangement, unfolding of the billiard table 10 from the vertical stored position to a horizontal playing position is accomplished in the reverse sequence. Once the billiard table 10 is in the horizontal position, the retractable wheels 34 may then be extended allowing the table to be moved to a suitable playing location.

Leveling of the billiard table top 12 is accomplished using the hydraulic leveling system/pump 48 depicted in FIG. 2. The billiard table top 12 in which the slate 36 is preferably bonded to a steel slab 38, rests on four pistons 42, which project down into hydraulic reservoirs 44. When a lever (not shown) on the billiard table is pulled or activated, a small plunger, for example, in one or more of the reservoirs 44 is disengaged. The reservoir that is then being interconnected allows hydraulic fluid 46 to flow through the hydraulic lines 50 and into all the reservoirs 44, thereby activating the pistons 42, and the billiard table top 12 essentially floats on the hydraulic fluid. The playing surface of the pool table can then be leveled via selectively introducing hydraulic fluid into the various reservoirs, thereby selectively biasing pistons 42.

A level sensor (or combination of level sensors, see, e.g., FIG. 9), situated approximately in the middle of the billiard table top 12 (or distributed throughout), is located essentially in the middle below the billiard table top 12, and is preferably connected to a lighted panel on the side of the billiard table 10. When the billiard table top 12 is level, and is so indicated on a lighted panel, the lever which was used earlier to float the billiard table top 12 is replaced sending the plunger back into the hydraulic fluid reservoir 44, thereby hydraulically locking the fluid, the steel slab and the billiard table top 12 into a level position. The billiard table is then ready for use/play.

Leveling of the billiard table top 12 can also be accomplished by the use of four electric motors, one at each corner of the billiard table top 12. In similar fashion, the billiard table top 12 can be leveled manually by low geared hand cranks, also situated one at each corner.

The wheels 34 are extended and retracted by either hydraulic or electronic means. Two or more of the wheels located on the retractable legs may also have gears, enabling the wheels to act as drive wheels, allowing the user to position the billiard table 10 without exerting physical force. The wheels may be driven either by electric motor or other means as available.

In another embodiment of this invention, ball bearings described above, may be incorporated within the billiard table support legs 20 allowing the billiard table to be rolled as may be necessary to position the billiard table within a room. Kickstand type brakes may also be mounted on the side of the billiard table support table legs 20 in order to prevent movement of the billiard table during play.

In this disclosure, there is shown and described only the preferred embodiment of the invention, but, as aforementioned, it is to be understood that the invention is capable of use in various other combinations and environments and is capable of changes or modification within the scope of the inventive concept as expressed herein.

What is claimed is:

1. A billiard table positionable from a horizontal playing position to an upright storage position, comprising:

a billiard table top with ball-receiving pockets and side cushions;

a support frame disposed below said table top to support said table top;

a plurality of retractable and extendable support legs disposed below the table top, said support legs being defined by a first set of support legs located near a first side of the billiard table, and a second set of support legs located near a second side of the billiard table, the first set of support legs being retractably and extendably connected to said support frame;

at least one extendable and retractable ram connected to said support frame on the first side of said billiard table for pivotable support when the billiard table is repositioned from the horizontal playing position to the upright storage position, and from the upright storage position to the horizontal playing position; and at least one control mechanism connected to said support frame and, in operation, controlling said first set of support legs and said at least one extendable and retractable ram.

2. A billiard table according to claim 1, wherein the second set of support legs are comprised of a first section, a second section, and a third section;

wherein the first section is pivotally connected at one end to a first end of the second section, the opposing end of the second section is pivotally connected to a first end of the third section, and the opposing end of the third section is pivotally connected to the support frame of the billiard table.

3. A billiard table according to claim 1, wherein said control mechanism is a hydraulic lift system within the billiard table support frame.

4. A billiard table according to claim 1, wherein each of the first and second sets of support legs further comprise a means for facilitating movement of the billiard table.

5. A billiard table according to claim 4, wherein the means for facilitating movement of the billiard table comprises wheels.

6. A method of storing a billiard table having a rams, retractable and extendable legs with retractable wheels, comprising the steps of:

(a) rolling the billiard table to a location near a storage wall using the wheels;

(b) positioning the billiard table along side the storage wall such that a side of the billiard table containing said rams is facing the storage wall;

(c) hydraulically retracting the retractable wheels within the retractable and extendable legs such that the retractable and extendable legs rest directly on a floor surface;

(d) retracting the retractable legs on the side of the billiard table closest to the storage wall inside the billiard table;

(e) extending the rams from the billiard table to the floor surface to act as a pivot point for storing the billiard table;

(f) extending the extendable legs on the side of the billiard table farthest from the storage wall hydraulically, forcing the billiard table to pivot on said rams and come to rest on its side in a vertical orientation.

7. A billiard table with a table edge positionable from a horizontal playing position to an upright storage position, comprising:

a billiard table top with ball-receiving pockets and side cushions;

a support frame disposed below said table top to support said table top;

a plurality of extendable and retractable support legs disposed below the table top, said legs being defined by a first set of support legs located near a first side of the billiard table, a second set of support legs located near a second side of the billiard table, the first set of support legs being pivotally and unfoldably extendable to raise the first side of the billiard table and the second set of support legs being retractable to lower the second side of the billiard table to reposition the billiard table from the horizontal playing position to the upright storage position, and the first set of support legs being pivotally and foldably retractable to lower the first side of the billiard table and the second set of support legs being extendable to raise the second side of the billiard table to reposition the billiard table from the upright storage position to the horizontal playing position; and at least one mechanism, operatively connected to said plurality of support legs, for alternatively extending and retracting the first and second set of support legs.

8. A billiard table according to claim 7, wherein said at least one mechanism comprises a hydraulic lift system in operative relationship with the first set of support legs, for folding and unfolding the first set of support legs.

9. A billiard table according to claim 7, wherein said at least one mechanism comprises a powered lift system in operative relationship with the first set of support legs, for alternately folding and unfolding the first set of support legs.

10. A billiard table according to claim 7, wherein said at least one mechanism comprises a powered lift system.

11. A billiard table according to claim 7, wherein each of the first and second sets of support legs further comprise means for facilitating movement of the billiard table.

12. A billiard table according to claim 11, wherein the means for facilitating movement of the billiard table comprises wheels.

13. A billiard table with a table edge positionable from a horizontal playing position to an upright storage position, comprising:

a billiard table top with ball receiving pockets and side cushions having a support frame;

a plurality of extendable and retractable support legs disposed below the table top, said legs being defined by a first set of support legs located near a first side of the billiard table, a second set of support legs located near a second side of the billiard table, the first set of support legs being extendable to raise the first side of the billiard table and the second set of support legs being retractable to lower the second side of the billiard table to reposition the billiard table from the horizontal playing position to the upright storage position, and the first set of support legs being retractable to lower the first side of the billiard table and the second set of support legs being extendable to raise the second side of the billiard table to reposition the billiard table from the upright storage position to the horizontal playing position; and at least one means for alternately extending and retracting the first and second set of support legs.

14. A billiard table according to claim 13, wherein said at least one means comprises a hydraulic lift system in operative relationship with the first set of support legs, and folding for unfolding the first set of support legs.

15. A billiard table according to claim 13, wherein said at least one means comprises a powered lift system in operative relationship with the first set of support legs, for alternately folding and unfolding the first set of support legs.

16. A billiard table according to claim 13, wherein said at least one means comprises a powered lift system.

17. A billiard table according to claim 13, wherein each of the first and second sets of support legs further comprise means for facilitating movement of the billiard table.

* * * * *